US010077555B2

(12) United States Patent
Higgins

(10) Patent No.: US 10,077,555 B2
(45) Date of Patent: Sep. 18, 2018

(54) ROOFING ELEMENTS AND SYSTEM

(71) Applicant: Christopher Lyndon Higgins, Noosa Heads (AU)

(72) Inventor: Christopher Lyndon Higgins, Noosa Heads (AU)

( * ) Notice: Subject to any disclaimer, the term of this patent is extended or adjusted under 35 U.S.C. 154(b) by 0 days.

(21) Appl. No.: 15/328,048

(22) PCT Filed: Sep. 1, 2015

(86) PCT No.: PCT/AU2015/000530

§ 371 (c)(1),
(2) Date: Jan. 22, 2017

(87) PCT Pub. No.: WO2016/033636

PCT Pub. Date: Mar. 10, 2016

(65) Prior Publication Data

US 2017/0247885 A1 Aug. 31, 2017

(30) Foreign Application Priority Data

Sep. 1, 2014 (AU) ..... 2014903467

(51) Int. Cl.
*E04D 12/00* (2006.01)
*E04D 1/34* (2006.01)

(52) U.S. Cl.
CPC ..... *E04D 12/004* (2013.01); *E04D 1/34* (2013.01); *E04D 12/006* (2013.01); *E04D 12/008* (2013.01); *E04D 2001/345* (2013.01); *E04D 2001/3411* (2013.01); *E04D 2001/3473* (2013.01); *E04D 2001/3494* (2013.01)

(58) Field of Classification Search
CPC ..... E04D 1/34; E04D 2001/3473; E04D 2001/345; E04D 2001/3411; E04D 2001/3494; E04D 12/004; E04D 12/006; E04D 12/008
See application file for complete search history.

(56) References Cited

U.S. PATENT DOCUMENTS

| | | | | | |
|---|---|---|---|---|---|
| 718,165 | A * | 1/1903 | Sneden | E04D 1/34 | 411/439 |
| 757,285 | A * | 4/1904 | Duchemin | E04D 1/34 | 52/547 |
| 1,544,391 | A * | 6/1925 | Budd | E04D 1/34 | 52/547 |
| 2,106,948 | A * | 2/1938 | Harrington | E04D 1/045 | 24/326 |
| 2,307,899 | A * | 1/1943 | Olsen | E04B 2/56 | 52/357 |

(Continued)

FOREIGN PATENT DOCUMENTS

| | | | | |
|---|---|---|---|---|
| AT | 404050 B | * | 7/1998 | E04D 1/34 |
| DE | 827248 C | * | 1/1952 | E04D 1/34 |
| DE | 3232106 A1 | * | 3/1984 | E04D 1/34 |
| EP | 0497690 B1 | * | 1/1996 | E04D 7/024 |
| FR | 2660001 A1 | * | 9/1991 | E04D 1/34 |
| FR | 2861771 A1 | * | 5/2005 | E04D 1/34 |
| FR | 2861774 A1 | * | 5/2005 | E04D 1/34 |
| FR | 3022571 A1 | * | 12/2015 | E04D 1/34 |
| GB | 160906 A | * | 3/1921 | E04D 3/365 |
| GB | 2150194 A | * | 6/1985 | E04D 1/34 |
| GB | 2172620 A | * | 9/1986 | E04D 1/34 |
| WO | WO 2017034415 A1 | * | 3/2017 | E04D 1/34 |

*Primary Examiner* — Babajide A Demuren
(74) *Attorney, Agent, or Firm* — Robert G. Lev

(57) ABSTRACT

An improved roofing system including a batten assembly comprising support battens and clips. The clips are made of metal wire having one portion shaped to retain roof outer coverings and a further portion shaped to secure the clip to the batten by spring torsion force of part of the clip acting against the batten.

9 Claims, 9 Drawing Sheets

(56) References Cited

U.S. PATENT DOCUMENTS 4,422,278 A * 12/1983 Fujihiro ..... E04D 3/365
52/478
5,617,690 A * 4/1997 Gibbs ..... E04D 1/34
52/518
5,642,596 A * 7/1997 Waddington ..... E04D 1/34
52/546
5,794,396 A * 8/1998 Gibbs ..... E04D 1/16
52/518
6,052,961 A * 4/2000 Gibbs ..... E04D 1/16
52/518
7,155,870 B2 * 1/2007 Almy ..... E04D 1/34
248/222.12
8,312,685 B2 * 11/2012 Gibbs ..... E04D 1/34
52/547
8,661,760 B2 * 3/2014 Williams ..... E04D 1/34
52/547
2007/0119117 A1 * 5/2007 Gibbs ..... E04D 1/34
52/698
2009/0272062 A1 * 11/2009 Gibbs ..... E04D 1/34
52/543

* cited by examiner

ROOFING ELEMENTS AND SYSTEM

The present invention relates roofing systems roofing outer coverings and corresponding energy gathering or producing means and more particularly, to battens used in roof construction and improved tile fixing means.

A problem of prior art in the field is the extended time necessary for workers operating in an elevated and potentially dangerous environment to manually affix battens and mounting or fixing means to attach or secure surface coverings including energy gathering surfaces to a roof.

BACKGROUND AND SUMMARY OF THE INVENTION

Any discussion of the prior art throughout this specification should in no way be considered as an admission that such prior art is widely known or forms part of common general knowledge in the field.

A roof structure having an outer layer or roof covering consisting one or more of a tiles or slates or panel or sheet or roof plane outer surface, hereinafter referred to as roof coverings or tiles, may advantageously have at least one area provided with or containing or covered with or supporting a means of gathering or producing energy including an electric current; said sheets or tiles or panels may include multiple layers of said means of gathering or producing energy. Such Roof Coverings are often manually handled into convenient groups ready to affix to the proximate roof structure elements including rafters and said roof structure elements hereinafter referred to as rafter or rafters.

As part of the process of fixing the Roof Coverings in place one or more skilled persons working in situ on the roof structure will normally also need to precisely position and apply or fix to the Rafters a means of restraining or holding said roof coverings in place on a roof structure, including the placement and fixing of load bearing battens hereinafter referred to as Support battens to support said roof coverings and the precise placement of a holding means or restraining means to removably or otherwise fix or retain tiles on the roof structure.

The present invention includes the provision of a means to connect roof coverings to a roof structure preferably including but not limited to a clip made of any suitable material including metal treated to provide a spring effect and having a means to fixingly and or removably hold or restrain or attach preferably in close proximity to at least one edge of one of said roof coverings in a desired position on Support battens and said means to connect roof coverings to a roof structure hereinafter referred to as metal clip and preferably said metal clip also providing a means of removably and or fixingly engaging with lightweight battens of any suitable material but preferably of metal such as in U.S. Pat. Nos. 7,454,873 and 7,448,177 McClintick which patents are hereby incorporated by reference in this application; said lightweight battens being not structural in the sense that they are not designed to bear roof load but instead are provided to conveniently fixingly and or removably anchor said metal clips in a precise and consistent alignment and said lightweight battens, or at least said metal clips being further affixed in a precise location on support battens. Said support batten when fixed in place on other structural elements of the roof frame such as rafters also transfers load carried by said support batten to said other structural elements of the roof frame such as rafters. The said support battens together with one or more metal clip or one or more of said lightweight battens affixed thereto may advantageously and preferably be assembled other than on a roof so that the said assembly, hereinafter referred to as the Support batten assembly, can be handled on a roof essentially like any structural batten to be affixed to the structure of a roof by efficient means as is commonly done by tradespersons applying such structural Support Battens to roofs. The advantage of a Support batten assembly is that it provides multiple precisely aligned metal clips to engage and affix roof coverings in a corresponding precise alignment thereby avoiding the need for tradespersons in situ on the roof to spend the time necessary to apply with precision at least a multiplicity of restraining means for roof coverings to elements of a roof structure.

Said support battens and support batten assemblys preferably also being of precise dimension and or having locational dimensions at least in relation to the width dimension measured in the direction parallel to the slope of the roof from eave to a roof ridge. Said dimensions or measurements referred to in this paragraph and hereinafter are measured with reference to normal in situ position on a roof structure. Advantageously the present invention also provides for a system and device to assist with roofing generally and in one specific instance to aid fixing precise location of each row of said support batten assemblys on said rafters in positions extending from the eave to the roof ridge; for example, starting from a first support batten assembly fixed on rafters in a desired position adjacent to a roof eave so as to set the position of the first or eave row of tiles and others of said support batten assembly located between the eave and the ridge of a roof, a first spacer piece or spacer device of appropriate material and dimension may advantageously be placed, at least temporarily, abutting the edge one or more rafters and the said first support batten assembly at the edge closest to the ridge-line of the roof hereinafter referred to as the Upper edge; said first spacer piece having a dimension between its Upper edge and corresponding lower edge such that when a second Support batten assembly is placed parallel to the first Support batten assembly and abutting one or more rafters and also abutting the Upper Edge of said first spacer piece, the desired gauge or spacing may be achieved between said Support batten Assemblies thus also achieving the desired gauge or spacing of roof coverings such as rows of slates or tiles which are affixed to said Support batten assemblies. Others of said spacer pieces and Support batten assemblies may be similarly placed in position to achieve the desired location of each row of roof coverings from roof eave to roof ridge. The gauge function of said spacer pieces in establishing the desired spacing apart of Support batten assemblies may also be performed by a device hereinafter referred to as Gauge Device which abuts or engages with one or more of Support batten assembly and Rafter. A Gauge Device may advantageously be adjustable to easily provide desired different spacings of Support batten assemblies.

Said Support Battens used to produce the said Support batten assemblies and spacer pieces or gauges may advantageously be formed from any suitable material preferably sourced from a renewable resource and including timber preferably being plywood and preferably from plywood having a water-resistant outer layer; and the locating and affixing of the Support battens in relation to the rafters by use of spacer pieces in the aforesaid manner provides a simple and easily verifiable means of correctly setting out the necessary "gauge" or vertical spacing of the Support batten assemblies so that each row of roof coverings such as tiles or slates will be correctly positioned; and if the said spacer pieces are constructed to be the same length and thickness as the said Support battens and permanently fixed in position there is additionally provided a contiguous surface covering rafters from eave to ridge which has superior load bearing to that provided by Support Battens alone. Such said contiguous surface covering rafters is advantageous in areas receiving additional loadings such as snowfall on roof coverings and is also useful in improving retention of tiles on a roof structure during extreme weather events when the air pressure acting on the outer surface of a tiled roof may at least temporarily become less than the air pressure within the building such that the higher air pressure within a building acts upon the contiguous undersurface of said support battens and spacer pieces before it can act on the underside of said roof tiles or roof sheets forming said outer layer of a roof structure and thus aiding in resisting the propensity of individual roof tiles to be dislodged in certain weather conditions.

Preferably said support battens and spacer pieces may be manufactured of a material available from sources having a minimal environmental impact and preferably from a sustainable re-growth harvesting source such bamboo or woodlot timber and said Support battens and spacer pieces may also be advantageously produced with abutting long edges shaped to co-operatively abut and engage so that when Support battens are fixed to the rafters of a roof structure said spacer piece is locked into position against the rafters between abutting support battens and thereby firmly retained without the need to have said spacer piece fixed to said rafters by mechanical separate fixings. Alternatively, said spacer pieces may also be fixed to said rafters by mechanical fixings similar to said Support battens so as to increase the holding force retaining the said Support battens and spacer pieces on said rafters.

Said roof covering or outer layer may for example also include; sheets or panels or tiles including those constructed of any suitable material or combination of materials including metals and plastics or glass, preferably including fiber reinforced cement or concrete, supporting on the surface, a solar energy or ambient heat harvesting means or a means of heating, as a coating on said tiles or surrounding one or more cell or layers of cells on or inset into and partially covering the surface of said tiles; including cells formed of one or more layers of elements or combinations or compounds or mixtures of said elements in the Periodic Table of Elements. Said Periodic Table of Elements may be seen at http://www.vertex42.com/ExcelTemplates/periodic-table-of-elements.html and which is by reference incorporated in this application.

Presentations by Robert Murray-Smith have been made since about 2011 concerning materials and methods which may be employed in the manufacture of devices suitable for the harvesting of solar and ambient energy layers of elements or combinations or compounds or mixtures of said elements in the Periodic Table of Elements including Carbon in graphene form as well as other materials including plastics and polymers, acids, alkalis and commercially available materials employed in making materials which may be employing in the manufacture of cells suitable for the harvesting of solar and ambient energy and said presentations were made by way of videos filed at https://www.youtube.com/user/RobertMurraySmith/videos?view=0&liveview=500&flow=list&sort=dd and the videos listed there are by reference in their entirety included in this application and following by way of example are references for some but not all of the videos hereby incorporated in this application.

Graphene Transparent, Flexible Brand New Solar Cell: https://www.youtube.com/watch?v=p5eRLxMHIi0&feature=iv&srcvid=aNGoXjQpU0 E&annotation_id=annotation 1124943505

Graphene Based Thermal and Solar Fluid: https://www.youtube.com/watch?v=yclCsb-IOa8

A Graphene Based Thermocell (Monotherm): https://www.youtube.com/watch?v=Zw8vXZHO5Ps Thermo Electric Generator From Graphene Ink: https://www.youtube.com/watch?v=Eiyz-WOX8c Thermal Power Generation From Graphene: https://www.youtube.com/watch?v=WVPu-9Hctl Graphene Heating Elements: https://www.youtube.com/watch?v=ADrb6jFdfLU Generating Electricity From A Coat Of Graphene Paint—Alternative Solar: https://www.youtube.com/watch?v=wSZGUV8D19I On Being Too Rigid And Thinking About Batteries, Supercapacitors and Solar Cells: https://www.youtube.com/watch?v=TrPR8nkGIrE The Thermocell—A Solar Cell You Can Paint On Anything: https://www.youtube.com/watch?v=5Nzbin6Zfvc Said solar energy or ambient heat harvesting means or a means of heating, as a coating on said tiles or layers preferably being thin like a paint coating or one or more layers of nanoparticles.

Roof coverings supporting of having on their surfaces said solar energy or ambient heat harvesting means or a means of heating may consist one single unit but take the form and appearance of an entire row of individual tiles; said reinforcing fibers being of one or more of materials which may be used singly or in combination, including but not limited to fibers of carbon, silicon and including Polymers such as Polyethylene or Polypropylene in all forms; said one or more of roof coverings consisting of or containing or supporting or having affixed thereto one or more energy producing and or collecting means and or an assembly or grouping of such means; including electricity harvested by Photovoltaic means and or means related to ambient heat and or the natural Electronegativity differences between the elements in the Periodic Table of Elements and disclosed for example in U.S. Pat. No. 6,103,054 Lovell Walter Carl which patent is hereby incorporated by reference in this application.

Said one or more energy producing and or collecting means also including a photovoltaic means such as disclosed in U.S. Pat. No. 4,321,416 Tennant which patent is hereby incorporated by reference in this application.

Said one or more electricity producing means connected to a means of conducting or transmitting the electricity to a storage device or to the electricity grid. Said means of producing conducting or transmitting the electricity may include one or more layers or coatings on said tiles or sheets; a strip or extrusion of metal or plastic including flexible plastics having one or more thin layers of, or having channels containing, one or more thin layers of electrical conducting material; said electrical conducting material including one or more elements from the Periodic Table of Elements and including preferably Carbon C as a graphene or a form thereof and or graphite and or graphene intercalated with one or more substance formed from the constituents of the periodic table of elements or compounds thereof and more preferably from the group including Nickel, Copper, Tin, Fluorine, Sodium, Chlorine; said strip or extrusion may also advantageously have integrally formed on or attached to the edges a means of sealingly joining said edges or by employing known means to join said edges to form a tube or shaped conduit suitable as a means to transmit or conduct electricity with less resistance than copper wires; said means of conducting or transmitting electric current may also include tubes or nano tubes of materials including carbon having an inner surface coated and or annealed or otherwise treated or coated.

In another exemplar of the present invention a means of harvesting the energy in ambient heat in or in close proximity to a roof surface is provided by replacing at least partially the "Slate Liner 140", referred to in U.S. Pat. No. 7,454,873 McClintick in FIG. 7 and elsewhere in the said US Patent, with a similar dimensioned liner comprising or having one or more of its surfaces at least substantially covered with one or more layers of elements from the Periodic Table of Elements or combinations or compounds of said Elements and said replacement liner disposed with a collection means so that energy can be obtained from ambient heat similar to the disclosures referred to in U.S. Pat. No. 6,103,054; alternatively said liner replacement of said Slate Liner 140 may be a more robust liner with increased resistance to UV and other degrading influences by the combination or lamination of a more resistant layer together with a layer of polymer such as high density polyethylene HDPE; said more resistant layer preferably being a metal such as stainless steel or at least a substance highly resistant to degradation by UV radiation or at least highly resistant to degradation by natural processes over effluxion of an extended time period consistent with the expected longevity of a traditional slate roof which may exceed 100 years of useful service.

The present invention includes a system whereby, after fixing of Support Batten Assemblies and or spacer pieces to Rafters of a roof frame structure, groups of roof coverings including roof tiles or slates are be conveyed to the roof structure by means of a crane or other lifting means in discrete groups placed conveniently in quantity and location considering the load bearing capacity of the structure and provision of efficient access to the tradespersons to minimize distance from point of storage to point of affixing roof coverings to each Support batten assembly. Preferably the gross weight of each group including any container is less than 300 kilograms.

The present invention also provides a tile bearing container or means of keeping a group of Roof Coverings together during transport to a desired location on the roof and also during the process of applying the said roof coverings to the roof structure. The said container is also provided with a means to engage with elements of the roof framework such as rafters by means such as one or more surface or protrusion or cleat; said container may also have one or more restraining means to at least temporarily restrainingly connect said tile bearing container to the roof structure so as to prevent said tile bearing container and its contents from being dislodged from the said roof framing. Said tile bearing container is preferably removed from the roof structure for re-use together with any unused tiles after all the required tiles or slates are removed therefrom. Said tile bearing container reduces the need of manually conveying tiles to the point of use on a roof and improves safety and efficiency and reduces breakage and other consequential costs. In one embodiment of this aspect said one or more protruding cleats and or adjacent surface of said tile bearing container abut at least one rafter 200 and at least one of said Support battens 300 or 310 or Spacer Pieces 600 referred to in FIG. 2 and FIG. 3 and elsewhere herein The present invention also provides for an improved method and devices to assist tradespersons in safely and precisely installing the many and various elements including the many discrete roof plane surfaces which comprise a finished roof. One preferred device provides a computer based application hereinafter referred to as app, to convey electronically by Wi-Fi or other means, to a mobile telephone or other device carried by a tradesperson/user working on the roof, the details of the roofing job so that the multitude of vital information is always conveniently available without the need to leave the roof to review said information. The information provided may be via a lap top computer located safely on or nearby to the work site and provide; a roof diagram identifying each of the roof plane surfaces; dimensions and details of the roof including all relevant materials; all materials to be installed in conjunction or associated with the roof so that proper allowances may be made to allow for items such as roof penetrations or mountings or flashings which may be done by other trades. Such information may advantageously also include; details of other trades to do work associated with or connected with the roof including intended work schedule and contact details; and the app may usefully serve up a form to the user showing the dimensions of each roof plane surface and estimated batten spacing and all materials required and providing user to check measurements on the roof and input the actual measurements whereupon the app will re-calculate and transmit to the user the recalculated information. Transmitted information especially regarding tile/batten spacing may advantageously also be communicated to and received by another device which may adjusted mechanically to reflect the desired spacing of battens on a particular roof surface and confirm to the user by sound or visual response when the physical adjustment has achieved the received desired dimension at which point the user locks the device or gauge which may them be employed to set the spacing for all batten rows on that roof plane surface.

The present invention also provides for a system including a system for supporting roofing members on a roof structure, the system comprising: at least one batten plurality of roof covering retaining devices or clips secured or removably secured to a batten by spring torsion force of one arm of the clip acting on an a wall of an opening or pocket in the batten; the clip devices operable to support or retain roof coverings; wherein the roof coverings are slate or tile; and each slate or tile has a top edge and a bottom edge; and the bottom edge of each of the slate members is supported by one or more of said clip devices; wherein a bottom portion of each of the clip devices extends away from the roof to support the bottom edge of one of the slate members, and a top portion of each of the clip devices securely engages the at least one batten.

A System wherein the roof covering retaining clip devices are spring tempered.

A System further comprising one or more slate underlayers/liners, wherein each slate liner is positioned atop the roof covering retaining devices associated with a row of slate members, underlying the slate members of the row.

A System wherein a bottom portion of each of the roof covering retaining clip devices extends away from the roof to support the bottom edge of one of the slate/tiles and the slate liner, a top portion of each of the roof covering retaining devices securely engages the at least one batten, and a bottom edge of the slate liner is coincident with the bottom edge of the slate tiles.

A System further comprising an underlayment positioned on the roof structure below the battens.

A System further comprising a plurality of battens for accommodating a plurality of rows of slate, wherein the slate are operatively secured to the roof structure in overlapping rows, wherein the bottom portion of each of the roof covering retaining devices of one of the rows extends downward to partially overlap the slate members of the row immediately below.

A System wherein the slate liner of one of the rows completely underlies the slate members of the row, and wherein the upper edge of the slate liner extends up beyond the top edge of the slate members of the row.

A system for attaching slate members to a roof, the system comprising: at least one batten, the batten having a plurality of roof covering retaining clips disposed along its length, each roof covering retaining clips having spring torsion force portion to secure the clip removably or otherwise to a the batten; wherein each slate member has a top edge and a bottom edge, and wherein the bottom edge of each of the slate members is supported by one or more of said roof covering retaining clips; wherein a bottom portion of each of said roof covering retaining clips extends away from the roof to support the bottom edge of one of the slate members.

A System wherein the spring torsion force portion of the clip is sufficient for the roof covering retaining clips to resist lifting forces when attached to the at least one batten.

A System further comprising one or more slate liners, wherein each of said slate liner is positioned atop the roof covering retaining clips associated with a row of said slate members, underlying the slate members of the row.

A System wherein the slate liner and a top portion of each of said roof covering retaining clips securely engages the at least one batten, and the bottom edge of the slate liner is coincident with the bottom edge of the slate members.

A System further comprising a plurality of battens for accommodating a plurality of rows of said slate members, wherein the slate members are attached to the roof in overlapping rows, wherein the bottom portion of each said roof covering retaining clips of one of the rows extends downward to partially overlap the slate members of the row immediately below.

A System wherein the slate liner of one of the rows completely underlies the slate members of the row, and wherein the upper edge of the slate liner extends up beyond the top edge of the slate members of the row.

Is a perspective view of portion of a prior art Roof Structure 100 having a Ridge Line of Roof 101; Eave Line of Roof 110; Support battens 300 of timber fixed horizontally by known means to rafters 200 and said Support battens having a generally rectangular cross section of width and thickness adequate to support a calculated maximum loading between rafters; said cross sectional dimensions exclude the longest or length dimension and traditionally having a ratio of width divided by thickness of 3.0 or less; said dimension of width being taken as the larger of the two cross-sectional dimensions in calculating the said ratio.

A layer of waterproof Sarking material (not shown) extending at least from the ridge line to the eave line may be applied to cover the rafters and spaces between them before fixing the said Support battens to the Rafters; said sarking material will form a barrier to deflect water penetrating say through a broken tile to the eaves and preventing water from entering the rafters building space covered by said sarking.

FIG. 2

Figure 1:
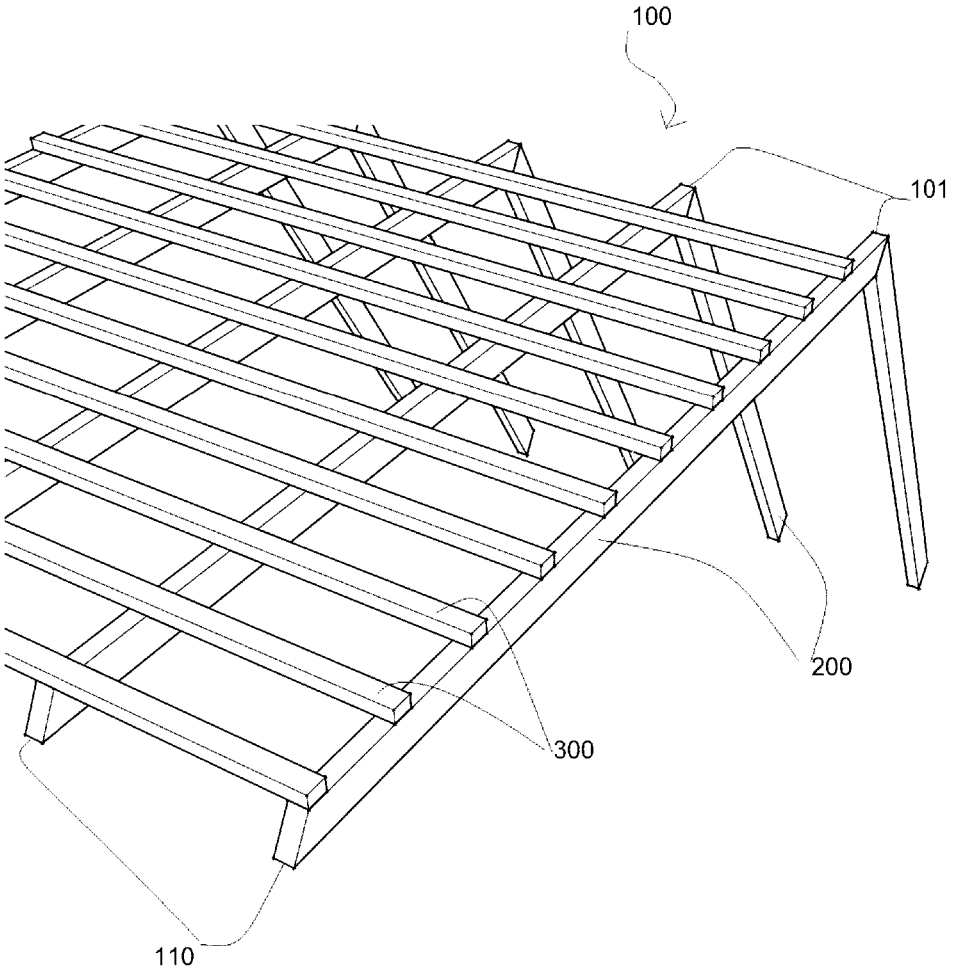
FIG. 1
Figure 2:
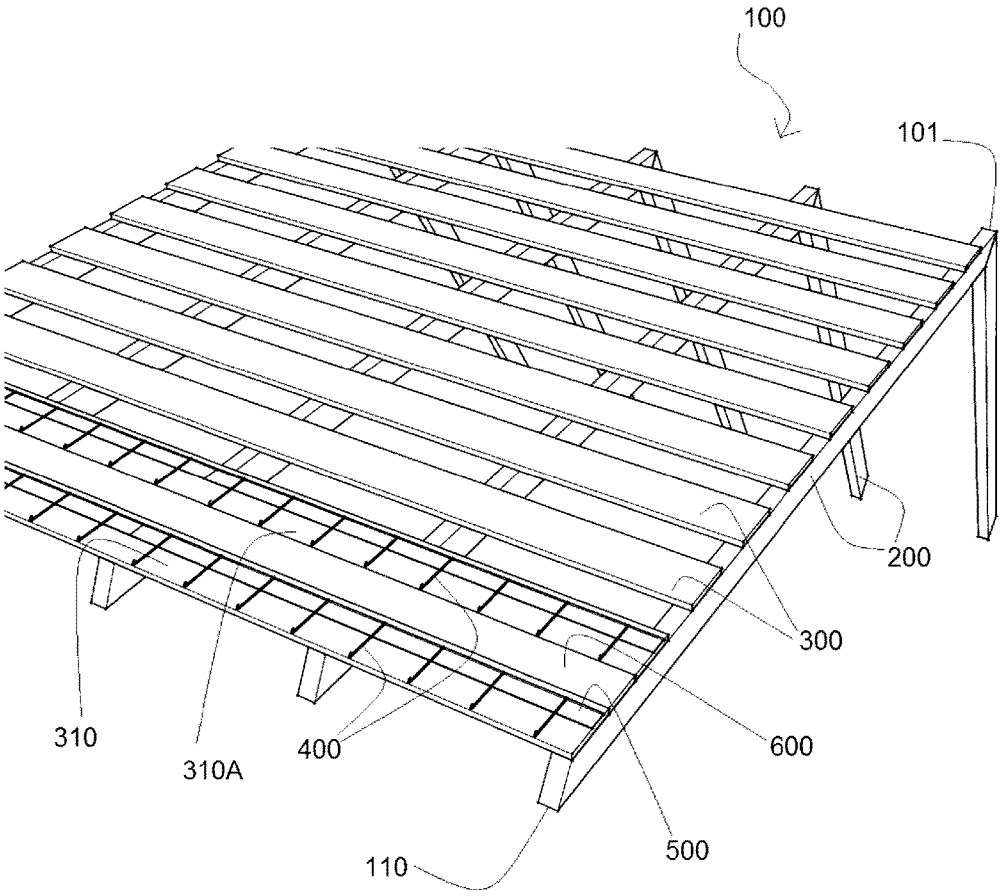

Is a partial perspective view of a first preferred example of the present invention. The view is similar to FIG. 1 but is additionally showing preferred Support Batten Assemblys 310 and 310A which advantageously improve upon the Support battens 300 of FIG. 1 by being manufactured to precise dimensions of width and thickness or height and having a cross-sectional dimension ratio of greater than 3 (said cross-sectional dimension ratio calculated by employing the dimensional concept and ratio calculation referred to in relation to FIG. 1 above) and said Support battens having affixed thereto prior to installation of said Support battens onto a roof structure a means 400 of holding or restraining tiles; in one preferred instance of the present invention there is shown in FIG. 2 lightweight battens 500 to which said tile holding or restraining means 400 are affixed or removably affixed (affixing means not shown); a Spacer Piece 600 being of precise dimension so that when a first Support batten 310 is located in the desired location and orientation with one long side adjacent to an eave edge then one of the long sides of a said first Spacer Pieces 600 may be abutted to the opposite long side of said first Support batten 310 such that the other of the long sides of said first Spacer Piece 600 can receive and abut against the lower long side of said next Support batten assembly 310A thereby providing a means of precisely locating the desired position of the next Support batten assembly 310A. Further Spacer Pieces and Support batten assemblys may be similarly abutted until the final Support batten is affixed adjacent to the ridge line 101. In this FIG. 2 and others, to simplify the drawings some of support battens 300 are shown without lightweight battens 500 and tile holding or restraining means 400.

Figure 6A:
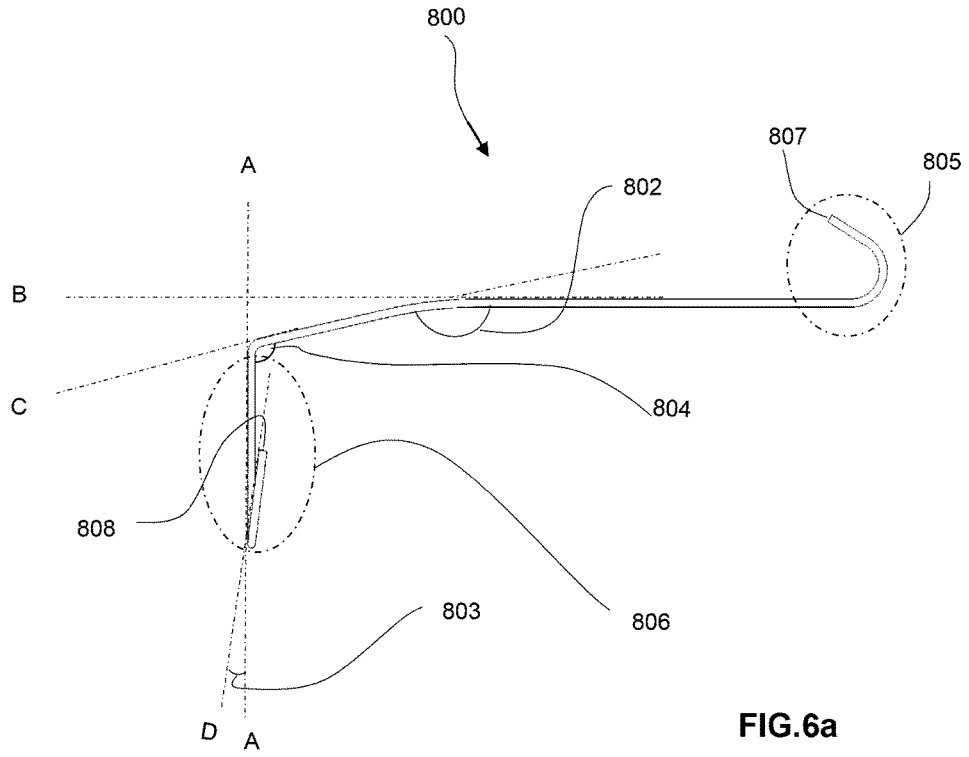
Figure 6B:
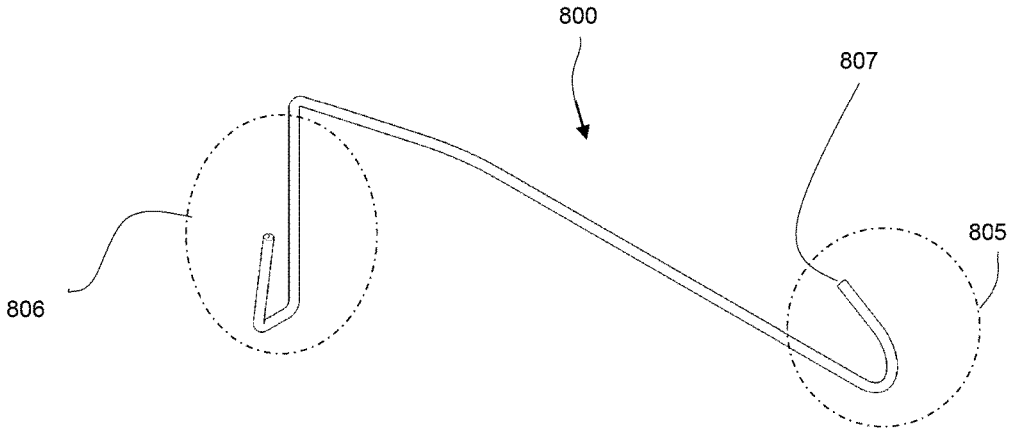
Figure 6C:
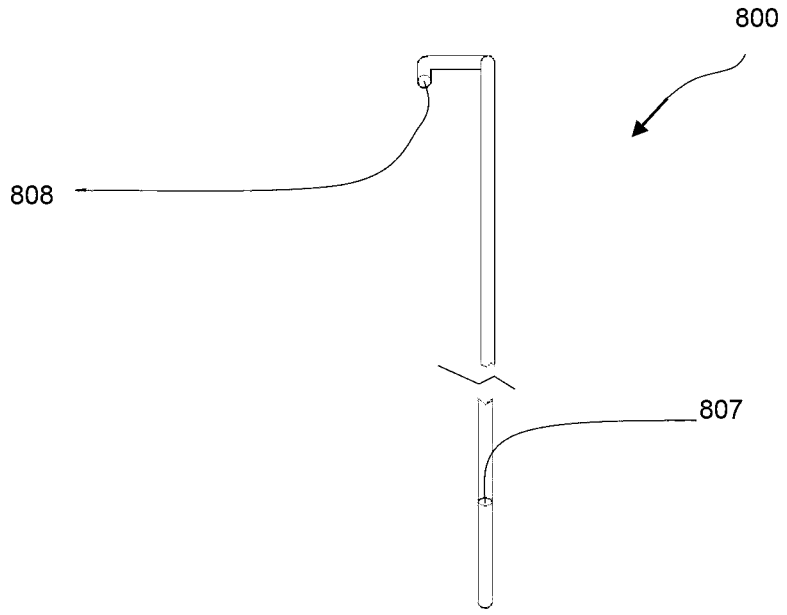
Figure 6D:
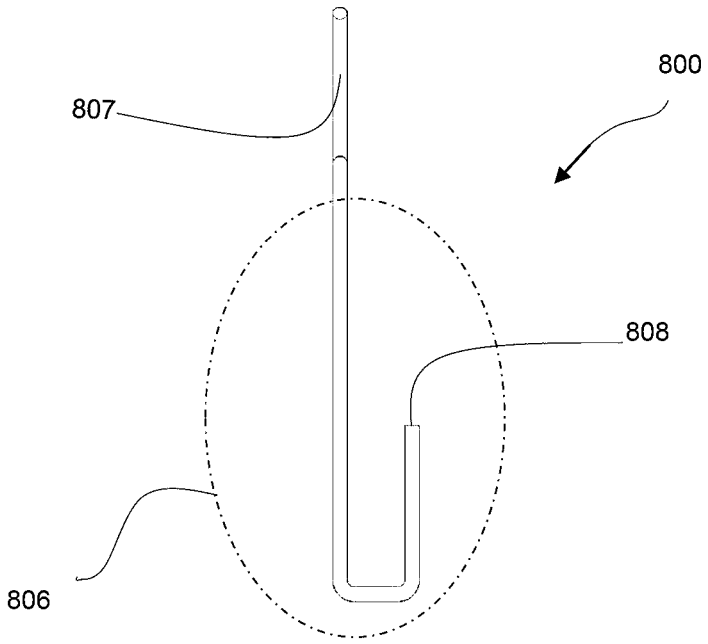
Figure 6E:
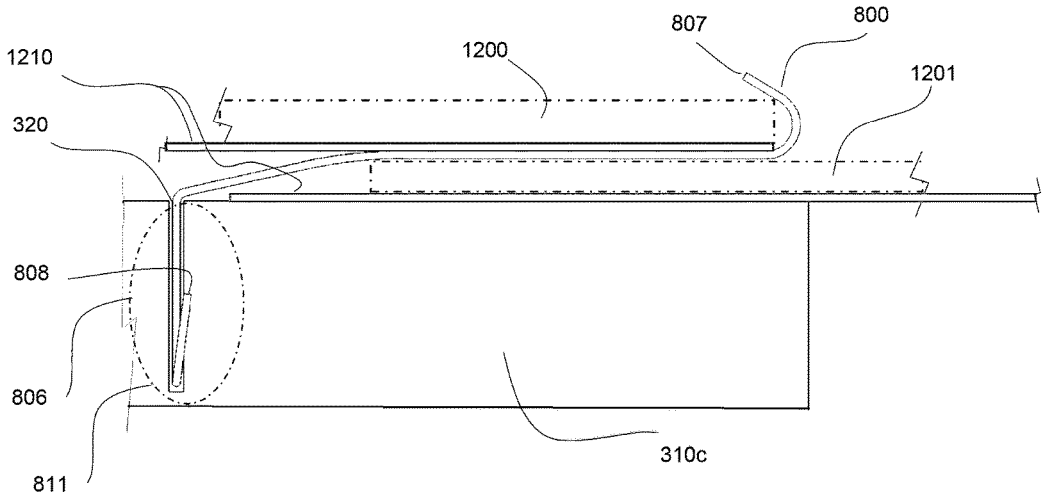
Figure 6F:
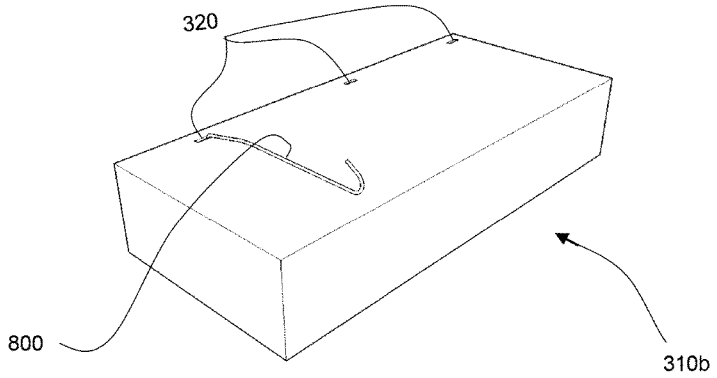
Figure 7:
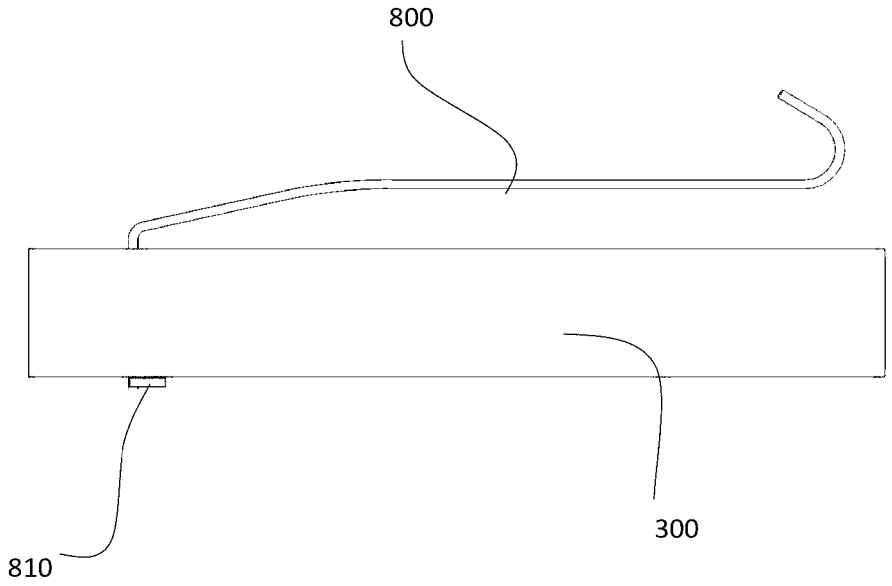

Referring to the tiles or slates that comprise the roof surface together with a slate liner 140 and together held or supported by holding or restraining means 400 are not shown here but may be seen in FIG. 6*e* slates numbered 1200 & 1201 and Slate liner or underlayer numbered 1210 and (referring to US patents incorporated herein) at FIG. 7 of U.S. Pat. Nos. 7,454,873 and 7,448,177 and elsewhere in said US patents.

FIG. 3 is a more detailed perspective view of the area in FIG. 2 occupied by portions of and showing the spatial relationship of Support batten assemblys 310 and 310A; spacer piece 600; tile holding or restraining means 400; lightweight battens 500; rafters 200; to simplify the drawing others of Support battens 300 are shown fixed in position without Lightweight Battens 500 and Tile restraining means 400 and fixings not shown.

FIG. 4

Is a partial perspective of the roof structure showing a movable tile and tools container 700 having wheels 720 which bear the weight of the container and any contents on the upper surface of at least one of Battens 310 or 300 and other wheels 740 acting on at least one of surfaces of battens 310 or 300 disposed at 90 degrees to the surface which is in contact with wheels 720; said movable container may have additional uses including a means of holding tools or the like; and which may additionally have removably attached or foldout working or standing surfaces (not shown) to assist workers or provide safety measures such as by providing a surface which can support or partially support the stance of a worker; such safety structures are useful in improving the efficiency and or safety of workers.

FIG. 5

Is a partial perspective view of modifications to corresponding abutting edges of Support batten assemblys 310 and 310A and spacer pieces 600 such that when Support batten assemblys are affixed (fixings not shown) to rafters 200 the spacer piece is held in position by the co-operating shape of edges 310B and 600C and their counterparts on the other edge of Spacer piece 600 without need for other fixings. However, to increase the level of fixings which may be desirable in geographical locations which experience cyclones or other extreme weather events the spacer pieces may be separately fixed (fixings not shown) to rafters 200

FIGS. 6*a*. to *f*. illustrate a illustrate a preferred embodiment of a clip made of metal wire which provides fixed or removable engagement means between a roof structure and Roof Coverings.

FIG. 6*a*

Figure 3:
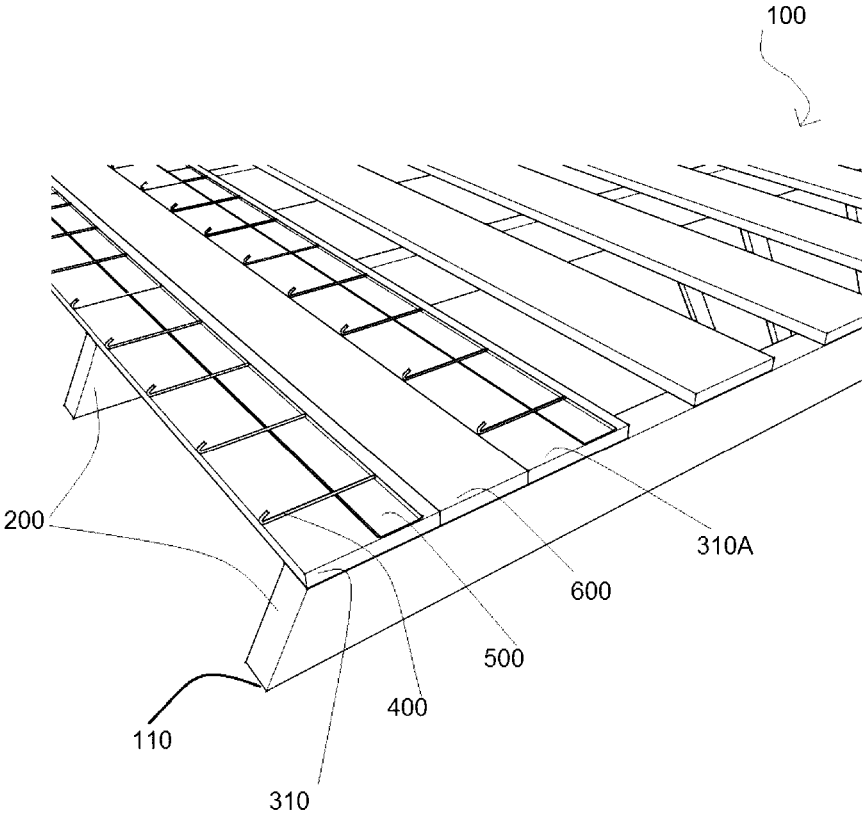
Figure 4:
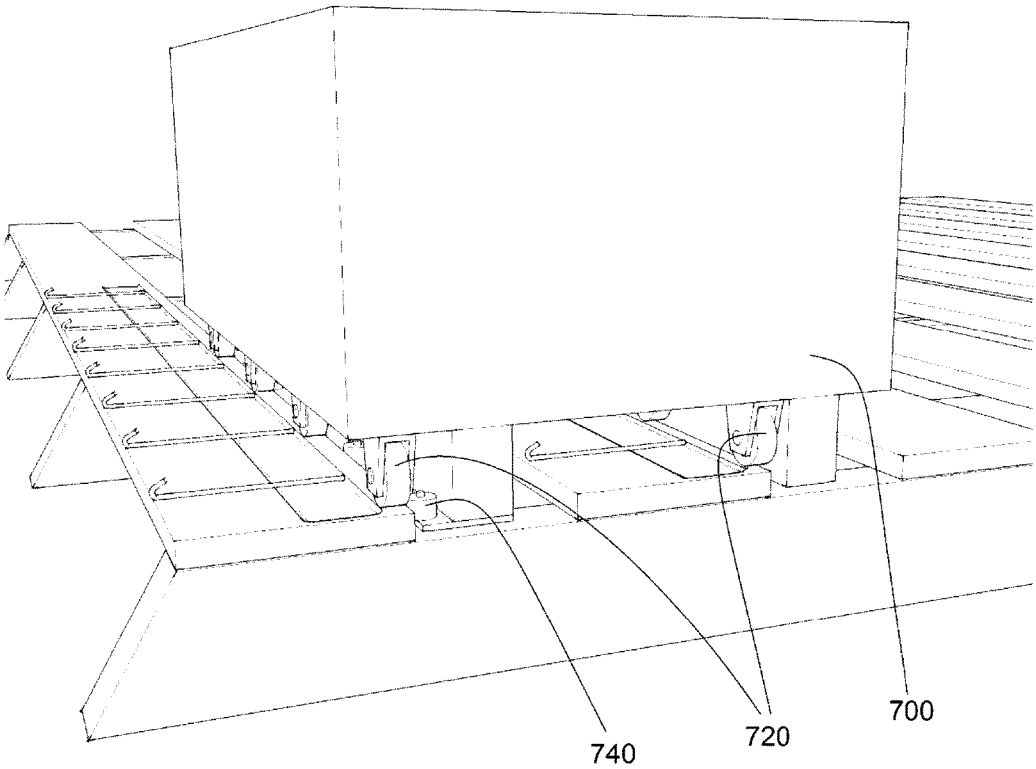
Figure 5:
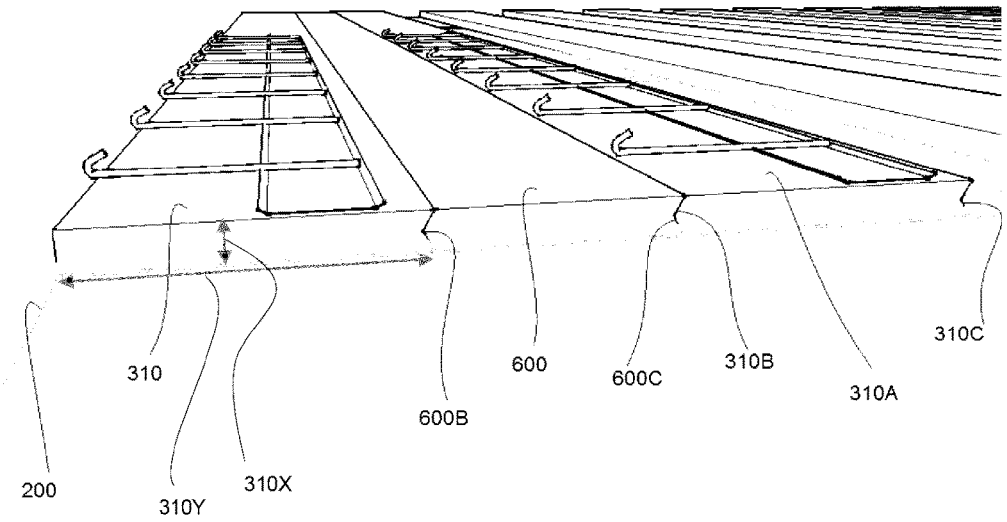

Shows a side view of a clip 800 shaped to retain roof coverings on a roof structure and having adjacent to end 807, a shape 805 configured to engage and restrain said roof coverings and at a distal end 808 a shape 806 configured to engage fixingly or removably with Support battens such as in FIG. 3 300 or lightweight battens 500. Preferably the elements of said clip configured so that; Bend or intersection 802 formed adjacent to the intersection of dotted lines B and C assists the said clip in retention of Roof Coverings. The included angle at intersection 802 is ideally greater than 95 degrees but less than 178 degrees and in one preferred instance is 168 degrees.

Bend or intersection 804 formed adjacent to the intersection of dotted lines D and A assists the said clip in retention of Roof Coverings. The included angle at intersection 804 is ideally greater than 20 degrees but less than 178 degrees and in one preferred instance is 102 degrees.

Angle 803 formed by dotted lines D and A when viewed in the present plane is a reflection of the the offset angle between elements of portion 806. A first element of said portion 806 extends from end 808 to a distal end of said first element at a point adjacent to the intersection of dotted lines 'D' and 'A' and a second element extending from a point adjacent to the vertex of angle 804 to a distal end point adjacent to a next bend corresponding in the present view with the intersection of dotted lines 'D' and 'A'. A third element connects the first and second elements and said third element is preferably up to 20% of the total length of the said clip.

The disposition of the said elements disclosed herein assists with placement of portion 806 of clip 800 into a fixed or removable engagement with (referring to FIG. 6*e*) Support batten 300 and retention of Roof Coverings.

The included angle corresponding to angle 803 is ideally between zero degrees and 360 degrees and in the preferred embodiment disclosed is 15 degrees.

Angle 803 determines the at rest position of end 808 and consequently the amount of "spring" force to be overcome when said first and second elements are aligned to enable insertion of portion 806 of clip 800 into (referring to FIG. 6*e*) pocket 320 of Support batten 300. Conversely, once inserted in pocket 320 the inherent spring force stored causes end 808 to engage with the wall of pocket 320 such that clip 800 is retained in pocket 320 of Support batten 300

FIG. 6*b*

Illustrates an isometric view of said roof coverings retaining clip 800 shown in FIG. 6*a*. and having adjacent to end 807, a shape 805 to engage and restrain said roof coverings and at another end 808 a shape 806 formed to engage fixingly or removably with Support battens such as in FIG. 3 300 and FIG. 6*e* or lightweight battens 500

FIG. 6*c*

Illustrates a parallel projection view from above of clip 800 shown in FIG. 6*a* and FIG. 6*b* and having end 807 and a distal end 808.

FIG. 6*d*

Illustrates a parallel projection view of metal clip 800 shown in FIGS. 6*a*, 6*b* and 6*c* end view looking at end 808, and having; a shape 806 formed to engage fixingly or removably with Support battens such as in FIG. 3 300 and FIG. 6*e* pocket 320 or lightweight battens 500

FIG. 6*e*

Illustrates view from one side of clip 800 together with a section of a Support batten 300 showing the cooperation between the wall of a pocket 320 in said Support batten 300 and the end 808 and adjacent portion 806 of clip 800; end 808 is drawn in the position it would occupy with no spring force restraining it against the wall of pocket 320; dotted line elongated rectangles 1200 and 1201 partially represent a sectional view of the location of roof coverings slates restrained by clip 800. Said slates 1200 retained by co-operation of parts of its surface abutting surfaces of clip 800 especially portion 805 thereof and by co-operation of one end of slate 1201 and adjacent/abutting surface of portion 805 of clip 800 and underlayer 1210; to insert slate 1201 end 807 must be raised against the natural spring force from its at rest position abutting the proximate surface of Support batten 300 and thus when slate 1201 is in the position shown herein there is a force exerted thereby in addition to down force exerted by slate 1200 to hold said slate 1201 and underlayer 1210 against the adjacent surfaces of Support batten 300.

Walls of Pocket 320 are intended to abut closely with the adjacent surfaces of portion 806 of clip 800 but for sake of clarity are drawn herein instead with a gap.

FIG. 6*f*

Illustrates a perspective view of a piece of a batten assembly 310*c* including clip 800, support batten 300 having pockets 320 to receive clips 800. Optionally after insertion of clip 800 into pocket 320 additional clip retention means may be employed by mechanical fixing such as a such as adhesive or a nail or screw inserted into pocket 320 or through the walls of pocket 320.

FIG. 7

Illustrates another exemplar of a roof coverings retaining clip 800 whereby the clip is affixed to the batten 300 by means of portion of clip 800 inserted through the material of the batten and secured by mechanical means 810.

While there has been shown and described a preferred embodiment of a roof covering system including energy gathering or producing surfaces, it will be appreciated that many changes and modifications may be made therein without, however, departing from the essential spirit of the disclosures herein.

All publications, patents, patent applications and other documents cited in this application are incorporated by reference in their entirety for all purposes to the same extent as if each individual publication, patent, patent application and/or other document were individually indicated to be incorporated by reference for all purposes.

The invention claimed is:

1. A system for mounting a panel array to a surface, said system comprising:

a) a plurality of battens operatively attached to said surface, each said batten comprising a plurality of apertures having interior walls; and, b) a plurality of panel holding clips arranged to span two adjacent panels of said panel array and configured to apply holding tension to both said adjacent panels when deployed, each said panel holding clip comprising i) a first segment arranged parallel to said adjacent panels where said adjacent panels overlap, said first segment having a hook portion extending around an edge of an upper one of said overlapping adjacent panels, ii) a second segment extending from said first segment at a first angle to said first segment, and extending beyond a lower one of said overlapping adjacent panels; and, iii) a third segment extending at a second angle from said second segment substantially perpendicularly to said first segment and into one of said apertures in one of said battens, creating tension with said first segment and said second segment, wherein said third segment effects a spring-tension fit in said aperture; wherein said third segment is configured in a substantially U-shape, said third segment comprising:

a) a main portion, extending from said second segment in a direction substantially 90° to said first segment;

b) a cross piece arranged 90° from said main portion, and extending from said main portion; and, c) a distal portion extending from said cross piece at a substantially 90° angle to said cross piece.

2. The system of claim 1, wherein said distal portion extends at an angle from an axis of said main portion so that said distal portion and said main portion exerts tension against opposite interior walls of said aperture.

3. The system of claim 2, wherein said angle between said distal portion and said main portion is between 1° and 15°.

4. The system of claim 3, wherein said panel array comprises a plurality of substantially parallel rows of panels mounted on a plurality of said battens.

5. The system of claim 4, wherein said panels comprise solar conversion units.

6. The system of claim 5, wherein said surface comprises a roof.

7. The system of claim 6, further comprising liners underlaying each of said adjacent overlapping upper and lower panels.

8. The system of claim 3 wherein said first angle is substantially between 95° and 178°.

9. The system of claim 8, wherein said second angle is between 20° and 178°.

* * * * *